US007954812B2

(12) United States Patent
Shimmachi et al.

(10) Patent No.: US 7,954,812 B2
(45) Date of Patent: Jun. 7, 2011

(54) IMAGE PROCESSING APPARATUS AND TRANSPORT DEVICE

(75) Inventors: Masaya Shimmachi, Kawasaki (JP); Haruo Ishizuka, Ichikawa (JP); Tadashi Hanabusa, Kawasaki (JP); Kenkichi Sakuragi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 12/473,567

(22) Filed: May 28, 2009

(65) Prior Publication Data

US 2009/0302520 A1 Dec. 10, 2009

(30) Foreign Application Priority Data

Jun. 9, 2008 (JP) ..... 2008-150710

(51) Int. Cl.
*B65H 5/00* (2006.01)

(52) U.S. Cl. ..... 271/264

(58) Field of Classification Search ..... 271/264, 271/266

See application file for complete search history.

(56) References Cited

U.S. PATENT DOCUMENTS

| | | | | |
|---|---|---|---|---|
| 5,558,451 | A | 9/1996 | Hanabusa et al. | 400/637 |
| 5,580,045 | A | 12/1996 | Matsumoto et al. | 271/298 |
| 5,653,433 | A | 8/1997 | Ishizuka | 271/121 |
| 5,732,321 | A | 3/1998 | Ishizuka et al. | 399/391 |
| 5,860,645 | A | 1/1999 | Tomura et al. | 271/10.13 |
| 6,246,491 | B1 | 6/2001 | Matsumoto et al. | 358/468 |
| 6,793,425 | B2 | 9/2004 | Yoshikawa et al. | 400/624 |
| 6,824,132 | B2 | 11/2004 | Asai et al. | 271/125 |
| 6,896,253 | B2 | 5/2005 | Hanabusa | 271/117 |
| 7,193,380 | B2 * | 3/2007 | Stout et al. | 318/373 |
| 7,343,129 | B2 | 3/2008 | Ahn et al. | |
| 2004/0253004 | A1 | 12/2004 | Stout et al. | 399/1 |
| 2005/0225623 | A1 * | 10/2005 | Hsieh et al. | 347/104 |
| 2006/0083550 | A1 | 4/2006 | Ahn et al. | 399/167 |

FOREIGN PATENT DOCUMENTS

| | | |
|---|---|---|
| JP | 7-140857 | 6/1995 |
| JP | 8-30166 | 2/1996 |
| JP | 10-017180 | 1/1998 |
| JP | 2-151880 | 6/2008 |
| KR | 100565087 | 3/2008 |

OTHER PUBLICATIONS

Official Letter/Search Report, dated Oct. 14, 2009, issued by the European Patent Office, in European Patent Application No. 09007559.9.

European Office Action dated Sep. 24, 2010, issued by the European Patent Office in European Application No. 09007559.9.

* cited by examiner

*Primary Examiner* — Michael C McCullough

(74) *Attorney, Agent, or Firm* — Fitzpatrick, Cella, Harper & Scinto

(57) ABSTRACT

An image processing apparatus stops the transport of a sheet when an access cover is opened to prevent the damage of the sheet, without additionally providing a sensor and has a transport member for transporting a sheet through an image processing unit; a driving mechanism for transmitting a driving force to the transport member; an access cover for opening a portion of a sheet transport path; and a driving switching unit for transmitting the driving force of the driving mechanism or cuts off the transmission of the driving force in operative association with the opening or closing of the access cover. The driving switching unit cuts off the transmission of the driving force to the transport member when the access cover is opened.

11 Claims, 8 Drawing Sheets

IMAGE PROCESSING APPARATUS AND TRANSPORT DEVICE

BACKGROUND OF THE INVENTION

1. Field of the Invention

The present invention relates to an image processing apparatus including a transport member for transporting a sheet through an image processing unit.

2. Description of the Related Art

In recent years, the following apparatuses have been proposed: a reading apparatus that separates documents one by one, transports the separated document, and reads the image of the document; and a recording apparatus that separates recording sheets one by one, transports the separated recording sheet, and records an image on the recording sheet. For example, a facsimile is used as the reading apparatus. In addition, for example, a printer or a copying machine is used as the recording apparatus. In the reading apparatus or the recording apparatus, in some cases, the transported document or recording sheet remains in a sheet transport path due to an error. An access cover for opening a portion of the transport path is provided in order to remove the sheet remaining in the transport path.

However, when the access cover is opened during a document read operation or an operation of recording an image on a recording sheet, it is difficult to normally transport a sheet, such as a document or a recording sheet. Therefore, an image processing apparatus has been used which includes a sensor for detecting the opening or closing of the access cover and stops when it is detected that the access cover is opened (see Japanese Patent Application Laid-Open No. H02-151880). However, since a sensor is additionally provided, the size of an apparatus increases, and an electronic part is added, which results in an increase in manufacturing costs.

SUMMARY OF THE INVENTION

The invention has been made in order to solve the above-mentioned technical problems. An object of the invention is to provide an image processing apparatus capable of stopping the transport of a sheet when an access cover is opened to prevent the damage of the sheet, without additionally providing a sensor.

According to an aspect of the invention, an image processing apparatus includes: a transport member for transporting a sheet through an image processing unit; a driving mechanism for transmitting a driving force to the transport member; an access cover for opening a portion of a sheet transport path; and a driving switching unit for transmitting the driving force of the driving mechanism or cuts off the transmission of the driving force in operative association with the opening or closing of the access cover. The driving switching unit cuts off the transmission of the driving force to the transport member when the access cover is opened.

According to the above-mentioned aspect of the invention, it is possible to provide an image processing apparatus capable of stopping the transport of a sheet when an access cover is opened to prevent the damage of the sheet, without additionally providing a sensor.

Further features of the present invention will become apparent from the following description of exemplary embodiments with reference to the attached drawings.

BRIEF DESCRIPTION OF THE DRAWINGS

FIG. 5A is a partial front view illustrating the operation of the driving switching unit when the access cover is opened, FIG. 5B is a partial front view illustrating the operation of the driving switching unit when the access cover is being closed, and FIG. 5C is a partial front view illustrating the operation of the driving switching unit when the access cover is closed.

FIG. 6A is a partial front view illustrating the operation of the driving switching unit when the access cover is closed, FIG. 6B is a partial front view illustrating the operation of the driving switching unit when the access cover is being opened, and FIG. 6C is a partial front view illustrating the operation of the driving switching unit when the access cover is opened.

DESCRIPTION OF THE EMBODIMENTS

Figure 1:
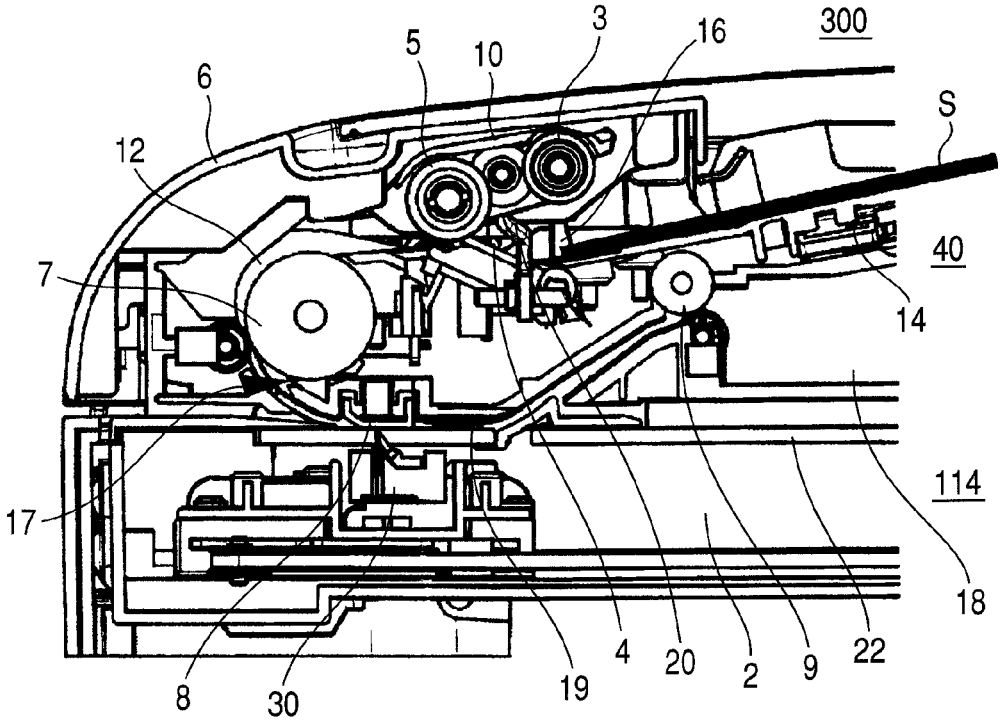
FIG. 1 is a front cross-sectional view illustrating a sheet transport path of a reading apparatus.

Hereinafter, exemplary embodiments of the invention will be described. In the drawings, the same or corresponding components are denoted by the same reference numerals.

Figure 2:
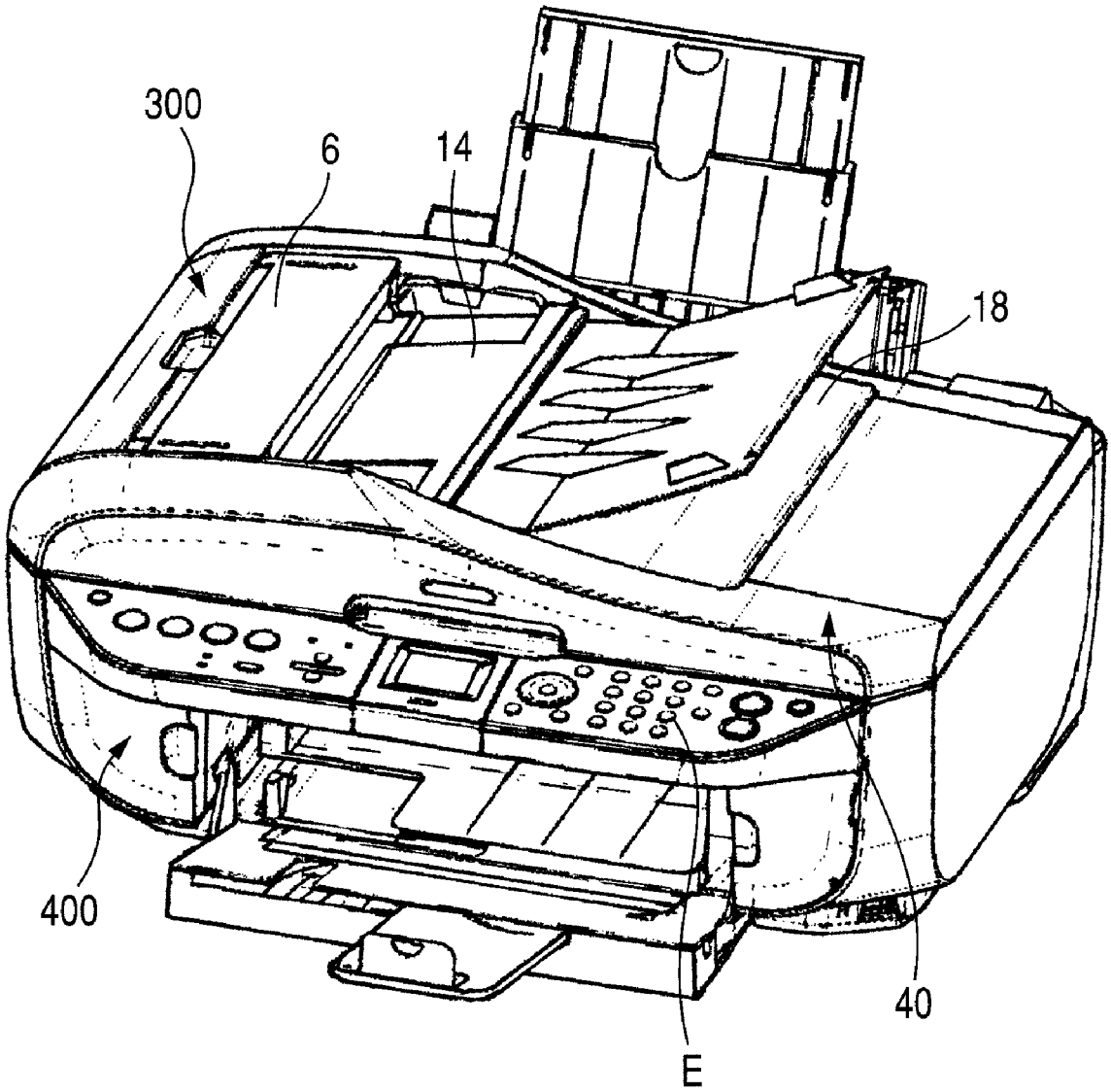
FIG. 2 is a perspective view illustrating the outward appearance of an image processing apparatus obtained by integrating the reading apparatus with a recording apparatus.
Figure 3:
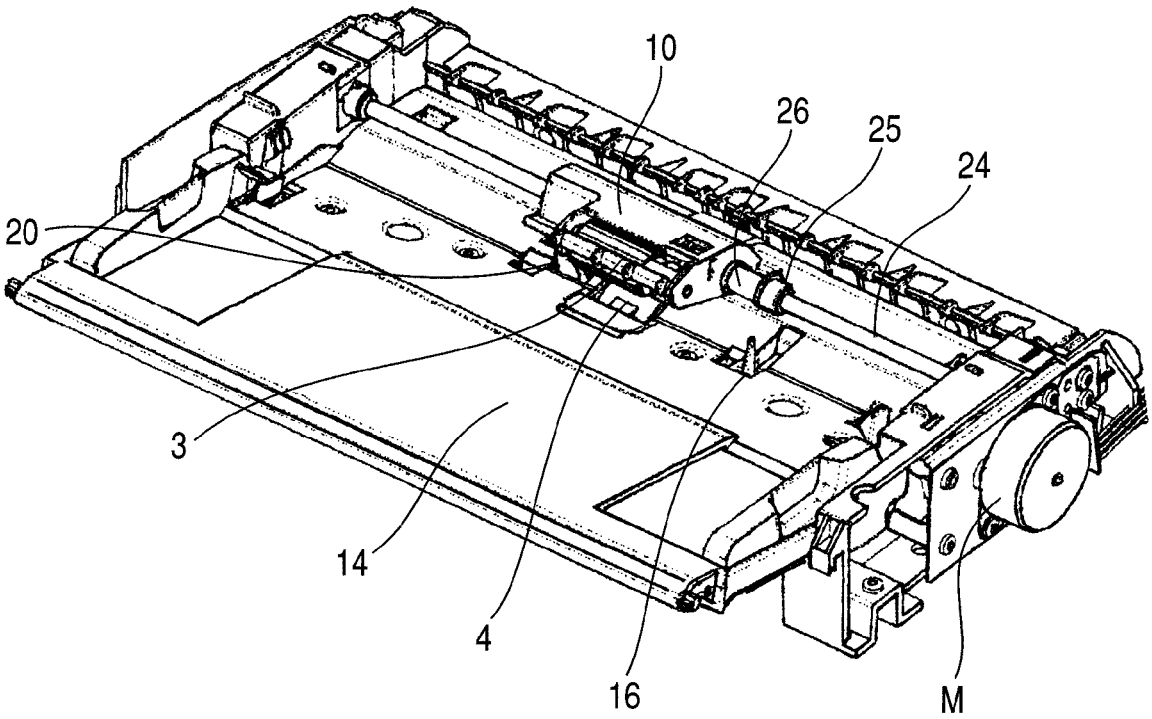
FIG. 3 is a perspective view illustrating a separating unit that separates documents one by one in the reading apparatus.

In this embodiment, an image processing apparatus is a reading apparatus. FIG. 1 is a front cross-sectional view illustrating a sheet transport path of a reading apparatus. FIG. 2 is a perspective view illustrating the outward appearance of an image processing apparatus obtained by integrating the reading apparatus with a recording apparatus. FIG. 3 is a perspective view illustrating a separating unit that separates documents one by one in the reading apparatus. In the image processing apparatus, the sheet transport path 12 having a substantially U shape (hereinafter, referred to as a U-turn path) through which a document S is transported is provided in a pressure plate unit 40. For example, a separation roller 5 to which a separation pad 4 is urged, a document presence/absence sensor 16 that detects whether there is the document S, a transport roller 7 that transports the document S, and a document edge sensor 17 that detects the leading end and the rear end of the document S are provided on the U-turn path 12 (transport path).

A document load tray 14 on which documents are loaded is provided on the upstream side of the U-turn path 12 in a direction in which the document S is transported, and the pressure plate unit 40 and a common document discharge tray 18 are provided on the downstream side of the U-turn path 12 in the transport direction. An access cover 6 that opens a portion of the U-turn path 12 is openably provided in a portion of the upper surface of the pressure plate unit 40. The inner surface of the access cover 6 forms a guide surface of the U-turn path 12. When a sheet jam occurs, the user can open the access cover 6 to remove the sheet jam.

A document stopper 20, the document presence/absence sensor 16, a pick-up roller 3, the separation pad 4, and a separation roller 5 are arranged on the upstream side of the U-turn path 12 in the transport direction. The document stopper 20 regulates the position of the leading end of the document S loaded on the document load tray 14. The document presence/absence sensor 16 detects whether there is the document S being transported or whether the document is passing through the path. The pick-up roller 3 comes into contact with the uppermost one of the loaded documents S and picks it up. The document S picked up by the pick-up roller 3 passes between the separation roller 5 and the separation pad 4 such that only the uppermost document is separated. As shown in FIG. 3, the driving force of a driving motor M is transmitted to a separation roller shaft 24 including a clutch hub 25 and a clutch spring 26 to drive the separation roller 5 and the pick-up roller 3. A discharge roller 9 that discharges the document S to a document discharge tray 18 is provided on the downstream side of the U-turn path 12 in the transport direction.

As described above, transport members for transporting the document S, such as the pick-up roller 3, the separation roller 5, the transport roller 7, and the discharge roller 9, are provided in the pressure plate unit 40. In addition, a flat head scanner 114 (reading unit), which is an image processing unit, is provided below the pressure plate unit 40. In this embodiment, the flat head scanner 114 is fixed to an upper part of a recording apparatus 400, and the pressure plate unit 40 is openably mounted to the flat head scanner 114. That is, the image processing apparatus according to this embodiment is formed by integrating a reading apparatus 300 including the flat head scanner 114 and the pressure plate unit 40 with the recording apparatus 400. A close contact image sensor 30 that reads the document S is provided in the flat head scanner 114. A document table 22, which is a transparent plate made of, for example, glass, is provided on the upper surface of the flat head scanner 114. In addition, an ADF glass 19 used for the stopped close contact image sensor 30 to read the document S is provided in a portion of the upper surface of the flat head scanner 114 corresponding to the lower side of the U-turn path 12.

When the document loaded on the document table 22 is read, the close contact image sensor 30 is moved in the left-right direction of the drawings to scan the surface of the document on the document table 22, thereby reading the document. When the document S transported along the U-turn path 12 is read, the close contact image sensor 30 stops at the position of a read white board 8 to read the document. For example, the close contact image sensor 30 is configured such that light is emitted from an LED array, which is a light source, to the document surface of the document S and reflected light is focused on a sensor element by a self-focusing rod lens array, thereby reading an image.

That is, the close contact image sensor 30 is formed so as to be movable in the left-right direction in the reading apparatus. Therefore, when the document loaded on the document table 22 is read, the close contact image sensor 30 scans the document from the left side to the right side of FIG. 1 to read the document. When the document transported along the U-turn path 12 is read, the close contact image sensor 30 stops at a read position shown in FIG. 1, and the read white board 8 presses the document S against the ADF glass 19 to read an image. When setting the document S in the document load tray 14, the operator sets the document S from the right side to the left side of FIGS. 1 and 2, with the document surface facing upward. When the document is set, the position of the leading end of the document S is regulated by the document stopper 20, and the document presence/absence sensor 16 detects that the document S is loaded.

Figure 4:
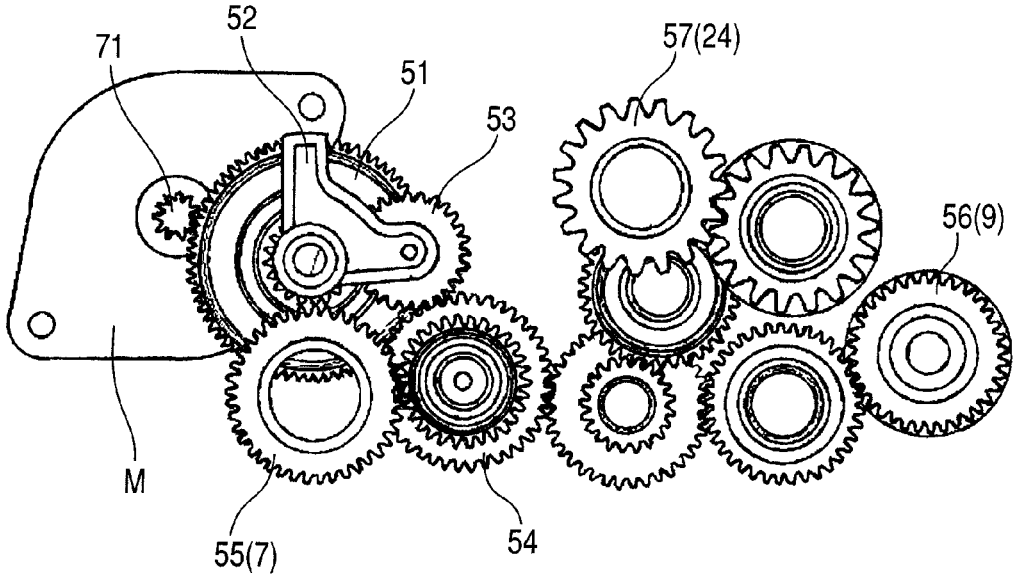
FIG. 4 is a front view illustrating a driving source and driving mechanism for driving a transport member.

FIG. 4 is a front view illustrating a driving source and a driving mechanism for driving the transport members. As described above, the image reading apparatus includes the separation roller 5 that separates sheets one by one, the transport roller 7 that transports the separated sheet, and the discharge roller 9 that discharges the sheet, as the transport members for transporting the document S. These rollers are driven by a driving source M, such as a DC motor, through the driving mechanism. A drive train from the driving motor M includes a sun gear 51, a swing arm 52, a planetary gear 53, a driven gear 54, a transport gear 55, a discharge gear 56, a separation gear 57, and a transmission gear train that connects the gears, which form a driving transmitting unit.

The sun gear 51 is arranged so as to be engaged with a motor gear 71 of the driving motor M. The sun gear 51 is a double gear. The swing arm 52 is arranged so as to be rotated about the same axis as the rotation axis of the sun gear 51. The planetary gear 53 rotatably supported by the swing arm 52 is engaged with a small-diameter gear of the sun gear 51. A predetermined friction is applied to the swing arm 52 to rotate the planetary gear 53 with the rotation of the sun gear 51. The planetary gear 53 is movable between a position where it is engaged with the driven gear 54 and a position where it is disengaged from the driven gear 54. The transport gear 55 is arranged on a shaft of the transport roller 7. The discharge gear 56 is arranged on a shaft of the discharge roller 9. The separation gear 57 is coaxially provided with the shaft 24 of the separation roller 5.

When the operator uses a control panel E to set a read mode and input an instruction to start a read operation, the driving motor M is rotated in the counter clockwise direction of FIG. 4. Then, the sun gear 51 is rotated in the clockwise direction, and the swing arm 52 is tilted in a direction in which the planetary gear 53 is engaged with the driven gear 54. Then, driving force is transmitted to the driven gear 54. Then, the transport gear 55, the discharge gear 56, and the separation gear 57 are driven through the transmission gear train to transmit the driving force to the transport roller 7, the discharge roller 9, and the separation roller shaft 24. In this way, the transport roller 7 and the discharge roller 9 are changed to a driving state capable of transporting the document S. The driving mechanism shown in FIG. 4 includes a drive train for transmitting the driving force from the driving source M to the transport members, such as the separation roller 5, the transport roller 7, and the discharge roller 9.

When the driving force is transmitted to the separation roller shaft 24, the document stopper 20 is pressed by the pick up arm 10 and the document S is transported into the U-turn path 12 through an inclined plane of the document stopper 20 by the pick-up roller 3. Then, the documents S are separated one by one by the separation roller 5 and the separation pad 4, and the uppermost document S is separated and transported. The separated document S is transported to the read white board 8 along the U-turn path 12 by the transport roller 7 such that it is read by the close contact image sensor 30. When the document edge sensor 17 detects the leading end of the document S, the document is transported from that position by a predetermined amount, and the close contact image sensor 30 starts an operation of reading image information while the document S is being transported. During the read operation, the read white board 8 presses the document S against the ADF glass 19.

The document S is read at the position of the ADF glass 19 while being transported, and then discharged to the document discharge tray 18 by the discharge roller 9. When the document edge sensor 17 detects the rear end of the document S, the document S is transported from that position by a predetermined amount, and the close contact image sensor 30 ends the operation of reading image information. Then, when the document presence/absence sensor 16 detects that there is the next document, the same document transport process as described above is continuously performed, and the close contact image sensor 30 reads image information. The gap between the documents transported along the U-turn path 12 is determined by, for example, a difference in circumferential speed between the transport roller 7 and the separation roller 5, or a mechanical timer provided in the pick-up roller 3 or the separation roller 5. In addition, the gap between the documents is determined considering the slip of the document while the document is being transported by the transport roller 7, the separation roller 5, and the pick-up roller 3. Further, the gap is determined by, for example, the length of the next document drawn from the document stopper 20 to the separation pad 4.

When the read operation ends, the driving motor M is rotated in the clockwise direction of FIG. 4. Then, the sun gear 51 is rotated in the counter clockwise direction, and the swing arm 52 is also tilted in the counter clockwise direction. Therefore, the planetary gear 53 is disengaged from the driven gear 54, and no driving force is transmitted to the transport roller 7, the discharge roller 9, and the separation roller shaft 24. The tiltable swing arm 52 and the planetary gear 53 form a driving force switching unit (a cutoff unit).

Figure 5A:
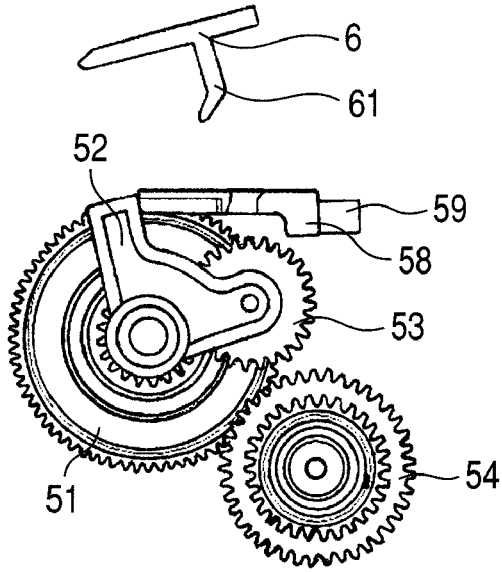
FIGS. 5A, 5B and 5C are partial front views illustrating the operation of a driving switching unit when an access cover is closed.
Figure 5B:
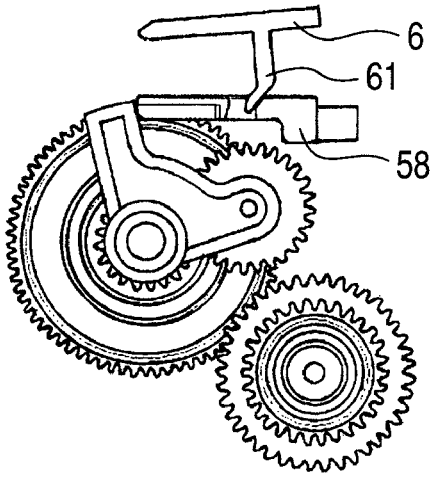
Figure 5C:
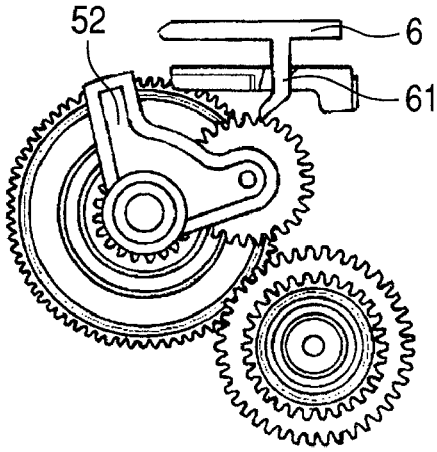

Next, the operation of the driving switching unit capable of selectively transmitting a driving force according to the opening or closing of the openable access cover 6 will be described. FIGS. 5A to 5C are partial front views illustrating the operation of the driving switching unit when the access cover is closed. FIG. 5A is a partial front view illustrating the operation of the driving switching unit when the access cover is opened, FIG. 5B is a partial front view illustrating the operation of the driving switching unit when the access cover is being closed, and FIG. 5C is a partial front view illustrating the operation of the driving switching unit when the access cover is closed. The driving switching unit shown in FIGS. 5A to 5C is configured so as to transmit driving force to the driving mechanism shown in FIG. 4 or cut off the transmission of the driving force in operative association with the opening or closing of the access cover 6. When the access cover 6 is opened, the driving switching unit cuts off the transmission of the driving force to the driving mechanism.

First, the operation of the driving switching unit when the access cover 6 is closed will be described. When the access cover 6 is opened, as shown in FIG. 5A, the swing arm 52 is rotated in the counter clockwise direction of FIG. 5A by a slider 58 that is urged to the left side of FIG. 5A by a slider spring 59. Therefore, the planetary gear 53 rotatably supported by the swing arm 52 is disengaged from the driven gear 54. In addition, in this embodiment, a compression spring is used as the slider spring. However, other types of springs may be used as the slider spring as long as they can urge the slider 58 in a predetermined direction. For example, a leaf spring, a tension spring, or a torsion coil spring may be used. Further, as a member for pressing the slider 58, an elastic member, such as rubber, may be used instead of the spring shown in FIG. 5A.

The pressing force of the slider spring 59 on the slider 58 is set to be greater than the friction applied to the swing arm 52. Therefore, even when the driving motor M is driven, the swing arm 52 is not rotated against the slider 58. Therefore, when the access cover 6 is in an open state, the planetary gear 53 is disengaged from the driven gear 54, and no driving force is transmitted. Since no driving force is transmitted to the transport members, the document is not transported.

When the access cover 6 is closed, as shown in FIG. 5B, a slider regulating portion 61, which is a pressing portion of the access cover 6, comes into contact with the slider 58 while the access cover 6 is being closed. When the access cover 6 is in the closed state shown in FIG. 5C, the slider regulating portion 61 moves the slider 58 to a position where the operation of the swing arm 52 is not regulated against the urging force of the slider spring 59. In this case, pressing force acting from the slider 58 to the slider regulating portion 61 by the urging force of the slider spring 59 is applied such that the access cover 6 is closed. In addition, when the access cover 6 is in the closed state, the operation of the swing arm 52 is not regulated by the slider 58. Therefore, the swing arm 52 can be rotated in both the driving force transmission direction and the driving force cutoff direction, thereby resuming the transmission of the driving force. That is, the swing arm 52 can be rotated in both the direction in which the planetary gear 53 is engaged with the driven gear 54 by the forward rotation of the driving motor M and the direction in which the planetary gear 53 is disengaged from the driven gear 54 by the backward rotation of the driving motor M.

Figure 6A:
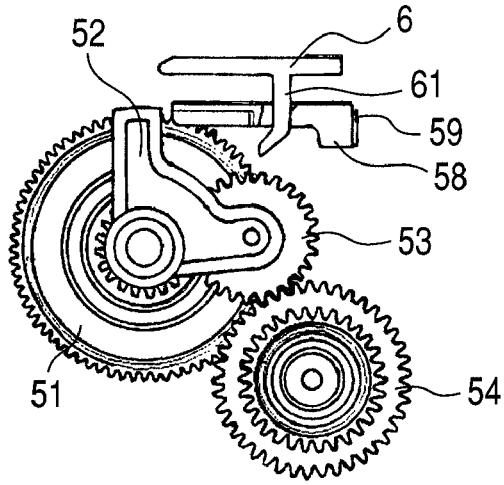
FIGS. 6A, 6B and 6C are partial front views illustrating the operation of the driving switching unit when the access cover is opened during the transport of the document.
Figure 6B:
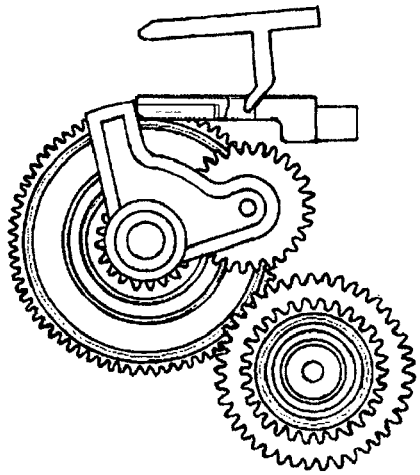
Figure 6C:
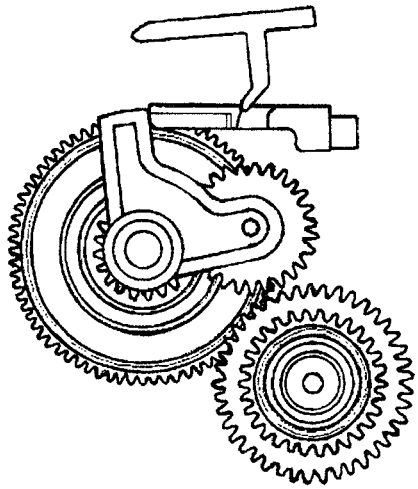

Then, the operation of the driving switching unit when the access cover 6 is opened during the transport of the document will be described. FIGS. 6A to 6C are partial front views illustrating the operation of the driving switching unit when the access cover is opened during the transport of the document. FIG. 6A is a partial front view illustrating the operation of the driving switching unit when the access cover is closed, FIG. 6B is a partial front view illustrating the operation of the driving switching unit when the access cover is being opened, and FIG. 6C is a partial front view illustrating the operation of the driving switching unit when the access cover is opened. As shown in FIG. 6A, when the access cover 6 is opened while the planetary gear 53 is engaged with the driven gear 54 to transmit driving force, the regulation of the slider 58 by the slider regulating portion 61 is released. Then, the swing arm 52 is rotated in the direction in which the planetary gear 53 is disengaged from the driven gear 54 (in the counter clockwise direction of FIG. 6A) by the pressing force of the slider 58 urged by the slider spring 59.

However, when the planetary gear 53 is engaged with the driven gear 54 to transmit driving force, force to engage the planetary gear 53 with the driven gear 54 is generated. Therefore, in order to disengage the planetary gear 53 from the driven gear 54, the slider 58 needs to press the swing arm 52 with a force greater than a rotation load occurring in the swing arm 52 when the planetary gear 53 is disengaged from the driven gear 54. When the urging force of the slider spring 59 is increased, a load to close the access cover 6 is increased. Therefore, strong force (load) is applied when the slider regulating portion 61 holds the slider 58, which is not preferable.

Therefore, in this embodiment, as shown in FIG. 6B, when the access cover 6 is opened, the slider regulating portion 61 comes into slide contact with the slider 58 to press out the slider 58 in the urging direction of the slider spring 59. That is, even when only the urging force of the spring acting on the slider 58 is insufficient to press the swing arm 52 and the planetary gear 53 is not disengaged from the driven gear 54, the movement of the access cover 6 is used to reliably rotate the swing arm 52. According to this structure, even when force to engage the planetary gear 53 with the driven gear 54 is generated, the slider regulating portion 61 can press the slider 58 until the planetary gear 53 is disengaged from the driven gear 54. In this way, after the slider regulating portion 61 presses the slider 58, the planetary gear 53 can be reliably disengaged from the driven gear 54, similar to the open state of the access cover 6 shown in FIG. 5A.

That is, in this embodiment, even when the access cover 6 is opened and the driving switching unit is disposed at the position where the driving force is transmitted, the driving switching unit can be moved to the position where no driving force is transmitted. Specifically, the driving switching unit includes the planetary gear 53 that is rotatably supported by the swing arm 52 and the slider 58 that can be moved between a regulation position that regulates the position of the planetary gear 53 and a separation position that does not regulate the operation of the planetary gear 53. Therefore, the slider 58 is urged to the regulation position by the slider spring 59.

When the access cover 6 is closed, the slider 58 is moved to the separation position by the slider regulating portion 61 provided in the access cover. When the access cover 6 is opened, the slider 58 is moved to the regulation position by the slider spring 59. In addition, when the access cover 6 is closed, the direction in which the slider regulating portion 61 presses the slider 58 is not the opening direction of the access cover 6. In addition, the pressing force of the slider spring 59 on the slider 58 is greater than the operation force of the planetary gear 53. At the position where the planetary gear 53 transmits the driving force to the driven gear 54, the transport members are driven and the access cover 6 is opened. In this case, after the slider regulating portion 61 operates the slider 58 such that the planetary gear 53 is disengaged, the slider regulating portion 61 is separated from the slider 58.

For the regulation of the rotating position of the swing arm 52, it is disadvantageous that the slider regulating portion 61 and the slider 58 are connected to each other all the time by, for example, a link mechanism, in terms of a cost and a space. Therefore, in this embodiment, when the access cover 6 is opened or closed, the slider regulating portion 61 comes into contact with the slider 58 for a predetermined period of time. After the force to engage the planetary gear 53 is released, the urging force of the slider spring 59 is greater than the rotating force of the general swing arm 52. Therefore, the driving mechanism is in the same state as that shown in FIG. 5A.

According to the above-described embodiment, it is possible to stop the transport of a document in the open state of the access cover 6 without additionally providing a sensor for detecting the opening or closing of the access cover 6. In this way, it is possible to provide an image processing apparatus capable of preventing a paper jam or the damage of a document when the access cover 6 is opened or closed.

Figure 7:
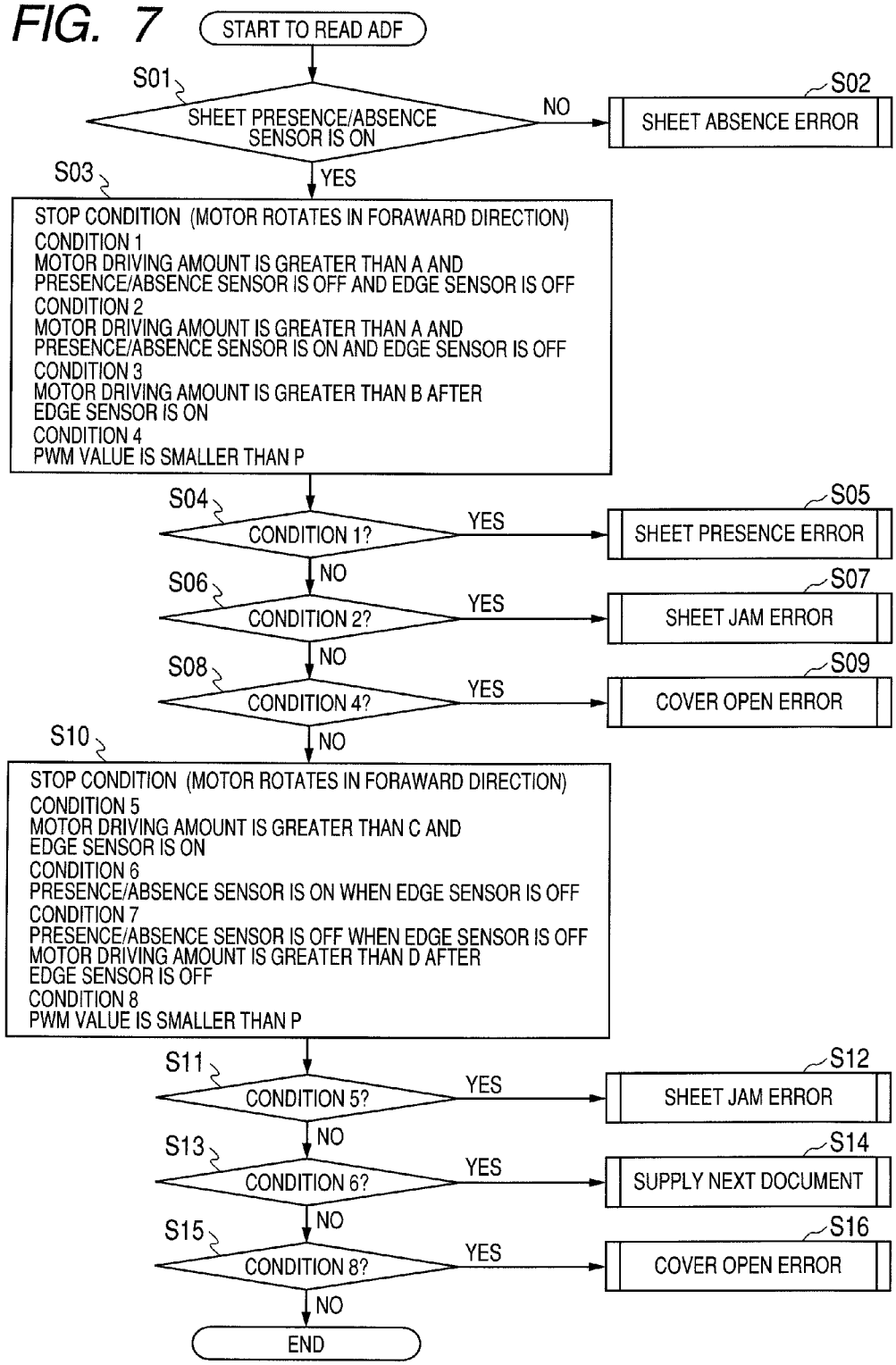
FIG. 7 is a flowchart illustrating the sequence of a document read process of the image processing apparatus.
Figure 8:
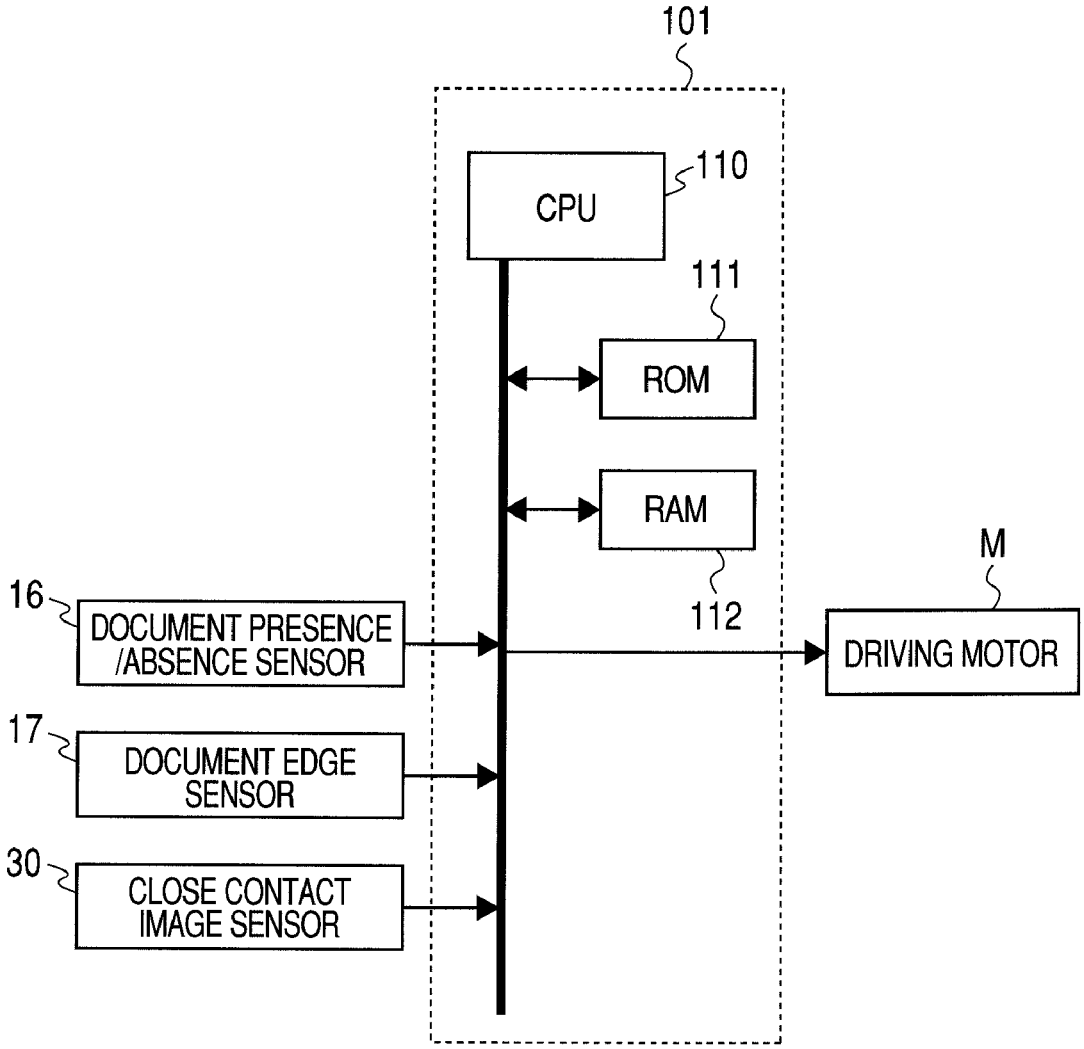
FIG. 8 is a control block diagram illustrating the image processing apparatus.

Next, the control of a document read process will be described. FIG. 7 is a flowchart illustrating the sequence of the document read process of the image processing apparatus. FIG. 8 is a control block diagram. A control circuit 101, which is a control unit, includes, for example, a CPU 110 that issues an instruction or performs determination, a ROM 111 that stores control programs or constants, and a RAM 112 that stores various data. The driving motor M is a DC motor.

In FIG. 7, when an ADF read operation starts, it is determined in Step S01 whether the document presence/absence sensor 16 is turned on. When it is determined that the document presence/absence sensor 16 is not turned on, it is determined in Step S02 that there is a sheet absence error. On the other hand, when it is determined that the document presence/absence sensor 16 is turned on, the process proceeds to Step S03. In Step S03, the driving motor M is rotated forward on the assumption that the process stops when any one of the following four stop conditions is satisfied. The first stop condition is that, even when a motor driving amount is greater than a set value A, the document presence/absence sensor 16 and the document edge sensor 17 are turned off. If it is determined in Step S04 that the first condition is satisfied, it is determined in Step S05 that a sheet absence error occurs.

The second stop condition is that, even when the motor driving amount is greater than the set value A, the document presence/absence sensor 16 is turned on and the document edge sensor 17 is turned off. If it is determined in Step S06 that the second condition is satisfied, it is determined in Step S07 that a sheet jam error occurs. The third stop condition is that, after the document edge sensor 17 is turned on, the driving amount of the driving motor M is greater than a set value B. The fourth stop condition is that the PWM value of the motor is smaller than a set value P. If it is determined in Step S08 that the fourth stop condition is satisfied, it is determined in Step S09 that the access cover 6 is opened. When the first to third stop conditions are not satisfied, the process proceeds to Step S10. For the fourth stop condition, for example, when the PWM value that is monitored at an interval of 1 ms is smaller than the set value (threshold value) P ten consecutive times, it is determined that the access cover 6 is being opened or has been opened, and the driving of the driving motor M stops. If the PWM value is greater than the set value P, the process proceeds to Step S10.

In Step S10, the driving motor M is rotated forward on the assumption that the process stops when any of the following four stop conditions, that is, the following fifth to eighth stop conditions is satisfied. The fifth stop condition is that, even when the motor driving amount is greater than a set value C, the document edge sensor 17 is turned on. If it is determined in Step S11 that the fifth stop condition is satisfied, it is determined in Step S12 that a sheet jam error occurs. The sixth stop condition is that, when the document edge sensor 17 is turned off, the document presence/absence sensor 16 is turned on. If it is determined in Step S13 that the sixth stop condition is satisfied, it is determined in Step S14 that the next document is fed.

The seventh stop condition is that, when the document edge sensor 17 is turned off and the document presence/absence sensor 16 and the document edge sensor 17 are turned off, the driving amount of the driving motor M is greater than a set value D. The eighth stop condition is a variation in the rotation speed of the motor. That is, the eighth stop condition is that the PWM value of the motor is smaller than the set value P. If it is determined in Step S15 that the eighth stop condition is satisfied, it is determined in Step S16 that the access cover 6 is opened. When the fifth to seventh stop conditions are not satisfied, a predetermined read operation is performed, and then the operation ends. For the eighth stop condition, for example, when the PWM value that is monitored at an interval of 1 ms is smaller than the set value P ten consecutive times, it is determined that the access cover 6 is being opened or has been opened, and the driving of the driving motor M stops. If the PWM value is greater than the set value P, the read operation is performed, and then the operation ends.

As described above, when a document read instruction is issued, a process corresponding to signals from the document presence/absence sensor 16 and the document edge sensor 17 is performed, and the PWM value of the driving motor M is monitored. The load when the driving motor M is driven with the drive train of the driving mechanism shown in the FIG. 6A being connected is different from that when the driving motor M is driven with the drive train of the driving mechanism shown in FIG. 5A being disconnected. The PWM (pulse width modulation) value of the driving motor M when the drive train is disconnected is smaller than that when the drive train is connected. Therefore, the threshold value P of the PWM value is set between a value when the drive train is connected and a value when the drive train is disconnected. In Step S03 and Step S10 of FIG. 7, when the PWM value that is monitored at an interval of 1 ms is smaller than the threshold value P ten consecutive times, it is determined that the access cover 6 is being opened or has been opened, and the driving of the driving motor M stops.

When the access cover 6 is opened, the drive train of the driving mechanism is disconnected, and no document is transported. However, when the time is out and the access cover 6 is closed before the driving motor M stops, the drive train is connected to transport a document. In this case, since the access cover 6 is opened, the state of the document is likely to be unstable. When the document is continuously transported in this state, the document is likely to be damaged. Therefore, if it is determined that the access cover 6 is opened on the basis of the PWM value, the driving of the driving motor M stops. In this way, it is possible to prevent a document from being directly transported when the access cover 6 is closed.

When the motor stops at a general timeout value determined on the basis of an assumed document length, for example, a length of 400 mm is set in legal paper having a total length of 355.6 mm. Therefore, in the read mode, it takes a long time until the driving motor M stops due to a timeout. Since the driving motor M stops when it is determined that the access cover 6 is opened, the user can rapidly perform the next operation.

According to the above-described embodiment, it is possible to provide an image processing apparatus capable of stopping the transport of a document when the access cover 6 is opened and preventing the damage of the document, without increasing a manufacturing cost due to the addition of a sensor. In addition, in the above-described embodiment, the reading apparatus is given as an example of the image processing apparatus. However, the invention is not limited thereto. For example, the invention can be similarly applied to a recording apparatus that transports a recording sheet and records an image on the recording sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-150710, filed Jun. 9, 2008, which is hereby incorporated by reference herein in its entirety.

What is claimed is:

1. An image processing apparatus comprising:

a transport member for transporting a sheet through an image processing unit;

a driving mechanism for transmitting a driving force to the transport member;

an access cover for opening a portion of a sheet transport path; and a driving switching unit for transmitting the driving force of the driving mechanism or cuts off the transmission of the driving force in operative association with opening or closing of the access cover, wherein the driving switching unit includes a sun gear, a planetary gear engaged with the sun gear, and a driven gear, wherein the planetary gear engages with the driven gear to transmit the driving force when the sun gear rotates in a first direction, and the planetary gear separates from the driven gear to cut off the transmission of the driving force when the sun gear rotates in a second direction opposite to the first direction in a state that the access cover is closed, and wherein the driving switching unit cuts off the transmission of the driving force to the transport member when the access cover is opened.

2. The image processing apparatus according to claim 1, wherein the transport member includes at least one of a separation roller that separates sheets one by one, a transport roller for transporting separated sheets, and a discharge roller that discharges the sheet.

3. The image processing apparatus according to claim 1, wherein, when the access cover is closed, the driving switching unit can selectively transmit the driving force.

4. The image processing apparatus according to claim 1, wherein, even when the driving switching unit is disposed at a position where the driving switching unit transmits the driving force, the access cover is opened to move the driving switching unit to a position where the driving switching unit does not transmit the driving force.

5. The image processing apparatus according to claim 1, further comprising:

a driving source, which is a DC motor, for driving the transport member; and a control unit that controls the DC motor on a basis of a PWM value, wherein, when the PWM value is smaller than a set value, the control unit determines that the access cover is opened and stops the DC motor.

6. The image processing apparatus according to claim 1, wherein the driving switching unit includes the planetary gear.

7. The image processing apparatus according to claim 6, further comprising:

a slider that is movable between a regulation position where said slider regulates the operation of the planetary gear and a separation position where the slider does not regulate the operation of the planetary gear, and is urged to the regulation position by a spring, wherein, when the access cover is closed, the slider is moved to the separation position by a pressing portion provided in the access cover, and when the access cover is opened, the slider is moved to the regulation position by the spring.

8. The image processing apparatus according to claim 1, wherein the image processing apparatus is a reading apparatus and the image processing unit is a reading unit that reads an image of a document.

9. The image processing apparatus according to claim 1, wherein the image processing apparatus is a recording apparatus and the image processing unit is a recording unit that records an image on a recording sheet.

10. A transport device comprising:

a transport unit for transporting a sheet along a transport path;

a driving unit for driving the transport unit;

a driving transmitting unit that selectively transmits a driving force to the transport unit;

an access cover that is openable and covers a portion of the transport path;

a cutoff unit that cuts off the transmission of the driving force of the driving transmitting unit in operative association with the opening of the access cover; and a control unit that detects a variation in the speed of the driving unit and stops the driving unit, wherein the driving switching unit includes a sun gear, a planetary gear engaged with the sun gear, and a driven gear, and wherein the planetary gear engages with the driven gear to transmit the driving force when the sun gear rotates in a first direction, and the planetary gear separates from the driven gear to cut off the transmission of the driving force when the sun gear rotates in a second direction opposite to the first direction in a state that the access cover is closed.

11. The transport device according to claim 10, wherein, when the access cover is opened, the cutoff unit maintains a cutoff state of the transmission of the driving force, and when the access cover is closed, the cutoff unit resumes the transmission of the driving force.

* * * * *